United States Patent [19]

Low et al.

[11] 4,411,530

[45] Oct. 25, 1983

[54] SYSTEM AND METHOD FOR RAPID BENEFICIATION OF BENTONITE CLAY

[75] Inventors: Philip F. Low, West Lafayette; Charles B. Roth, Battle Ground, both of Ind.; Joseph W. Stucki, Champaign, Ill.

[73] Assignee: Purdue Research Foundation, West Lafayette, Ind.

[21] Appl. No.: 339,098

[22] Filed: Jan. 13, 1982

[51] Int. Cl.[3] ..... B01F 3/06

[52] U.S. Cl. ..... 366/4; 366/7; 366/12

[58] Field of Search ..... 252/8.5 A, 8.5 B; 366/3, 4, 6, 7, 10, 12, 24, 25; 501/145, 146, 149, 150

[56] References Cited

U.S. PATENT DOCUMENTS

| | | | |
|---|---|---|---|
| 578,845 | 3/1897 | Tilden | 366/105 |
| 2,312,936 | 3/1943 | Smith | 366/24 X |
| 3,150,835 | 9/1964 | Horton | 252/8.5 B |
| 3,617,030 | 11/1971 | Tironi | 366/105 |
| 3,860,514 | 1/1975 | Lee et al. | 501/150 X |
| 4,015,973 | 4/1977 | Perrine | 501/145 X |

*Primary Examiner*—Robert W. Jenkins
*Assistant Examiner*—Arthur D. Dahlberg
*Attorney, Agent, or Firm*—O'Rourke & Harris

[57] ABSTRACT

A system and method for rapid beneficiation of bentonite clay is disclosed. Beneficiation of the bentonite clay occurs through oxidation of structural ferrous iron. For rapid beneficiation, bentonite clay, preferably ground, is subjected to moist air while the clay is being agitated, preferably by tumbling within a rotating drum, to provide rapid exchange of moisture and oxygen in the air with the bentonite clay aggregates to thereby increase the speed of oxidation of ferrous iron in the bentonite clay. Drying of the thus treated bentonite clay may be then achieved by agitating the clay, again preferably by tumbling within a rotating drum, in the presence of dry air.

15 Claims, 4 Drawing Figures

SYSTEM AND METHOD FOR RAPID BENEFICIATION OF BENTONITE CLAY

FIELD OF THE INVENTION

This invention relates to treatment of bentonite clay and, more particularly, relates to a system and method for rapid beneficiation of bentonite clay.

BACKGROUND OF THE INVENTION

Bentonite clay has proved to be useful where a swelling agent is necessary or desired since, as is well known, one property of such clay is to swell in the presence of moisture.

Bentonite clay is an essential ingredient of drilling muds in petroleum production. At the present time, bentonite clay is in short supply because of the increase in drilling activity due to the energy crisis and the extensive use of this clay in moulding sands. While bentonite clay from the upper horizons of a geological deposit is often quickly usable, it has been heretofore customary to beneficiate bentonite clay from the lower horizons of a geological deposit by spreading it out on the surface of the ground and allowing it to "weather" for at least a year to improve the product quality. However, in order to meet the demand of the petroleum industry, the poorer quality bentonite clay from the lower horizons of the deposit has sometimes been mixed, without the benefit of weathering, with the bentonite clay from the upper horizons of the deposit to thereby reduce the over-all quality of the product.

SUMMARY OF THE INVENTION

This invention provides a system and method for rapid beneficiation of bentonite clay. Bentonite clay, in a ground state, is subjected to moist air while the clay is being agitated to increase the rate of oxidation of ferrous iron in the bentonite clay the result of which is rapid beneficiation of the bentonite clay. By so treating bentonite clay, the clay is beneficiated in a very short time such as, for example, a few hours or even a few minutes.

It is therefore an object of this invention to provide a system and method for rapid beneficiation of bentonite clay.

It is another object of this invention to provide a system and method for beneficiation of bentonite clay in a very short time.

It is still another object of this invention to provide a system and method for rapid beneficiation of bentonite clay by exposing such clay to moist air while the clay is being agitated.

With these and other objects in view, which will become apparent to one skilled in the art as the description proceeds, this invention resides in the novel construction, combination, arrangement of parts, and method substantially as hereinafter described, and more particularly defined by the appended claims, it being understood that such changes in the precise embodiment of the herein disclosed invention are meant to be included as come within the scope of the claims.

BRIEF DESCRIPTION OF THE DRAWINGS

The accompanying drawings illustrate a complete embodiment of the invention according to the best mode so far devised for the practical application of the principles thereof, and in which.

DESCRIPTION OF THE INVENTION

Figure 1:
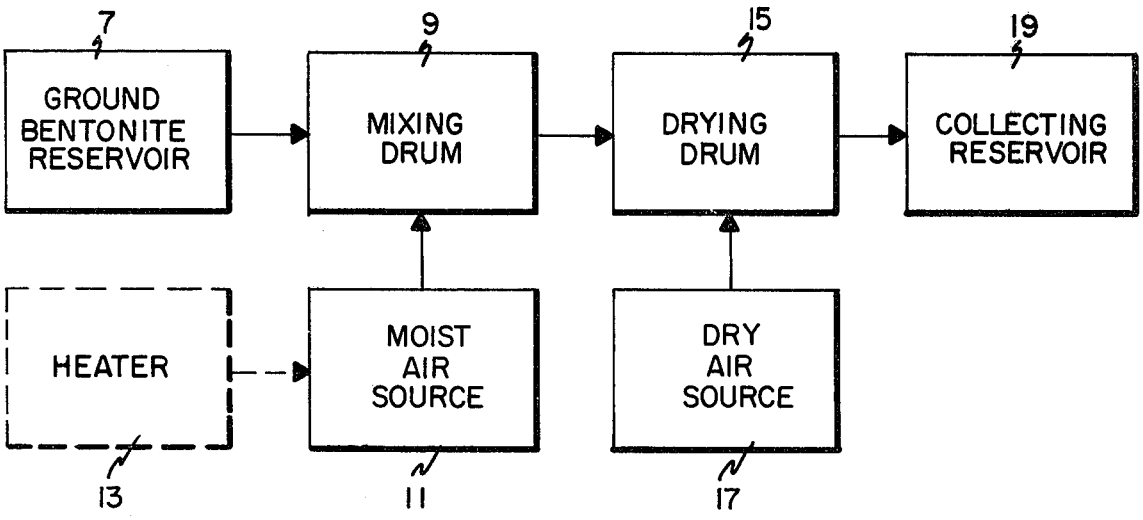
FIG. 1 is a block diagram of the system of this invention for rapid beneficiation of bentonite clays.

In 1953, M. D. Foster (American Mineralogist 38:994–1006, 1953) noted that Wyoming bentonite clay from great depths in the deposit was blue-gray in color and swelled unit its volume reached about 40 ml/g; whereas, bentonite clay from shallow depths was olive-green in color and swelled until its volume reached about 60 ml/g. She also pointed out that the only difference in the chemical composition of the two bentonite clays was in the state of oxidation of the octahedral iron. The octahedral iron in the blue-gray form was largely in the ferrous state, while the octahedral iron in the olive-green form was largely in the ferric state.

Attention to these observations was made by P. F. Low ("Mineralogy in Soil Science and Engineering", Soil Sci. Soc. Amer. Spec. Publ. no. 3, pp. 1–34, 1968). Also, it was later pointed out by J. C. Davidtz and P. F. Low (Clays and Clay Minerals 18:325–332, 1970) that the observations are consistent with the observation that swelling of Wyoming bentonite clay is negatively correlated with the b dimension of the component crystals.

It was presumed that the oxidation of the iron in the crystal decreased the b dimension and, thereby, increased the swelling. However, when it was found by J. W. Odom and P. F. Low (Clays and Clay Minerals 26:345–351, 1978) that there is a linear relation between the specific surface area and the b dimension, it was realized that swelling was really correlated with the specific surface area instead of the b dimension.

Consequently, it was concluded that, when ferrous iron in the crystals composing the bentonite clay is oxidized to the ferric state, a larger fraction of the superimposed crystal layers will separate to expose more surface area and increase swelling. In other words, the reason for the observations of M. D. Foster is that the blue-gray bentonite (containing predominately ferrous iron) had fewer expandable layers than the olive-green bentonite (containing the ferric iron) and, hence, had a smaller specific surface area and swelled less.

Not only is swelling dependent upon the fraction of expanding layers, as reflected by the specific surface area, but so is the rheology of the bentonite clay (Margheim, J. F. and Low, P. F., Soil Sci. Soc. Amer. Journal 42:688–693, 1978). Therefore, it was considered reasonable to believe that oxidation of ferrous to ferric iron in the crystals composing the bentonite clay improves its rheological properties.

It has been established (Stucki, J. W. and Roth, C. B., Soil Sci. Soc. Amer. Journal 41:808–814, 1977) that the iron in octahedral sites of a clay mineral like that composing bentonite clay can be oxidized readily by oxygen if water vapor is present. It is reasonable to assume, therefore, that the beneficiation of bentonite clay by allowing it to weather on the surface of the ground for a year was the result of oxidation in a moist environment. Therefore, beneficiation can be accomplished much more rapidly by forcing warm, moist air through ground bentonite while it is being agitated (such as being tumbled in a drum, shaken on screen, or contained in a tank).

The beneficiation of bentonite clay through oxidation of structural ferrous iron can be accomplished by any system or method wherein the clay is subjected to moist air while the clay is being agitated. The most rapid and efficient system and method involves the passing of moist air over the bentonite at some time after grinding and before it is prepared for distribution.

The entire operation is dependent upon having both water vapor and oxygen present in the bentonite clay at the same time. In current operations, the clay is removed from the geologic beds in a moist form; however, the aggregates are very large and so diffusion of oxygen into these aggregates is very slow. Therefore, it takes a long time for the clay to "weather" on the surface after it is taken from the beds. Since bentonite clay is very sticky when wet, it must be dried before it can be submitted to grinding operations. Thus, when the aggregates are very small, after the grinding operation, there is not enough water present to allow the oxygen to react with the clay plates.

The now preferred system for rapid beneficiation of bentonite clay is shown in FIG. 1. A source, or reservoir, 7 of ground bentonite clay is fed to a mixing drum 9 (preferably a slightly inclined rotating drum) to continuously feed the ground bentonite clay to the mixing drum. In mixing drum 9, the bentonite clay is constantly agitated by tumbling while moving through the drum. Moist air is applied to drum 9 from a moist air source 11 and, if desired or necessary, the moist air can be heated by heater 13. Thus, in drum 9 the agitated bentonite clay is subjected to moist (or warm moist) air which promotes rapid exchange of moisture and oxygen in the air with the bentonite aggregates while minimizing the tendency of the aggregates to stick together as they adsorb moisture. Thus, oxidation of structural ferrous iron is rapidly achieved. The use of heated moist air increases the speed of oxidation because of the increased amount of water the air is able to carry and also by the increased diffusion rate of oxygen with the aggregates of bentonite clay. The speed of oxidation will also be improved by oxygen enrichment of the supplied air.

After exiting from drum 9, the thus treated bentonite clay is preferably inserted into a drying drum 15 (also preferably a rotating drum), which drum receives dry air from dry air source 17. The thus dried clay is then collected at collecting reservoir 19 where the beneficiated clay can then be normally processed for use without the necessity of aging for a prolonged period of time as was heretofore necessary.

Beneficiation of bentonite clay can also be achieved by forcing moist air up through the sieves normally used to screen ground bentonite before shipment. A possible problem could occur, however, due to sticking of the bentonite aggregates to the sieves caused by the water being adsorbed by the aggregates.

Moist air could also be passed through ground bentonite in a batch type operation. In this case, the ground clay is placed into a larger container and moist air is introduced into the bottom of the container. The flow rate is determined by the physical size of the container. A disadvantage is due to the adsorption of water by the aggregates in the bottom of the tank which can cause such aggregates to become sticky and possibly completely restrict the movement of moist air to the rest of the tank or container.

In addition, oxidation can proceed most rapidly and efficiently if the bentonite is first suspended in water. In this case, the suspension must be aerated for a very short period of time, (on the order of five to ten minutes) with air and/or oxygen. A disadvantage is due to the great expense and time involved in removing the water from the clay before further processing.

In summary, in order to shorten the time required for the beneficiation of bentonite clay, it was necessary to understand the reactions and processes that are responsible for beneficiation. By then correlating information from a wide range of investigations, it was concluded that: (1) the swelling and rheology of bentonite clay depends on the specific surface area; (2) beneficiation is due to an increase in the specific surface area of the bentonite clay arising from an increase in the fraction of expandable layers in its component crystals; (3) the fraction of expandable layers increases when the octahedral iron in the crystals is oxidized from the ferrous to the ferric state; and (4) oxidation of octahedral iron by gaseous oxygen is facilitated by the presence of water or water vapor.

A distinct advantage of the system and method of the preferred embodiment of this invention is the mixing of the ground bentonite clay with moist air (which may be warm) in a rotating drum so that the reaction responsible for beneficiation, i.e., oxidation of octahedral iron, is accomplished in a short time (i.e., in a few hours instead of a year). Another advantage is that the mechanical handling of the bentonite clay is reduced.

Figure 2:
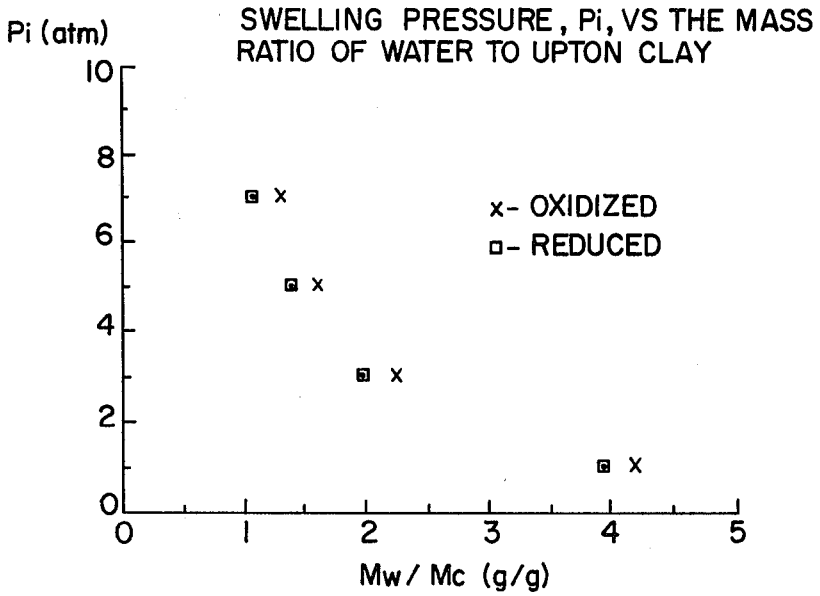
FIGS. 2 and 3 are graphs illustrating swelling pressure versus mass ratio of water to clay for oxidized and reduced Upton and nontronite clays.
Figure 3:
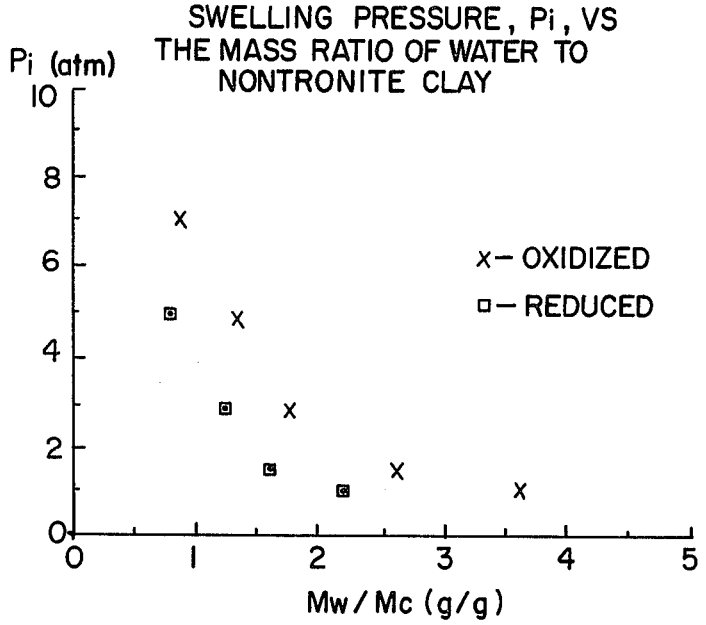
Figure 4:
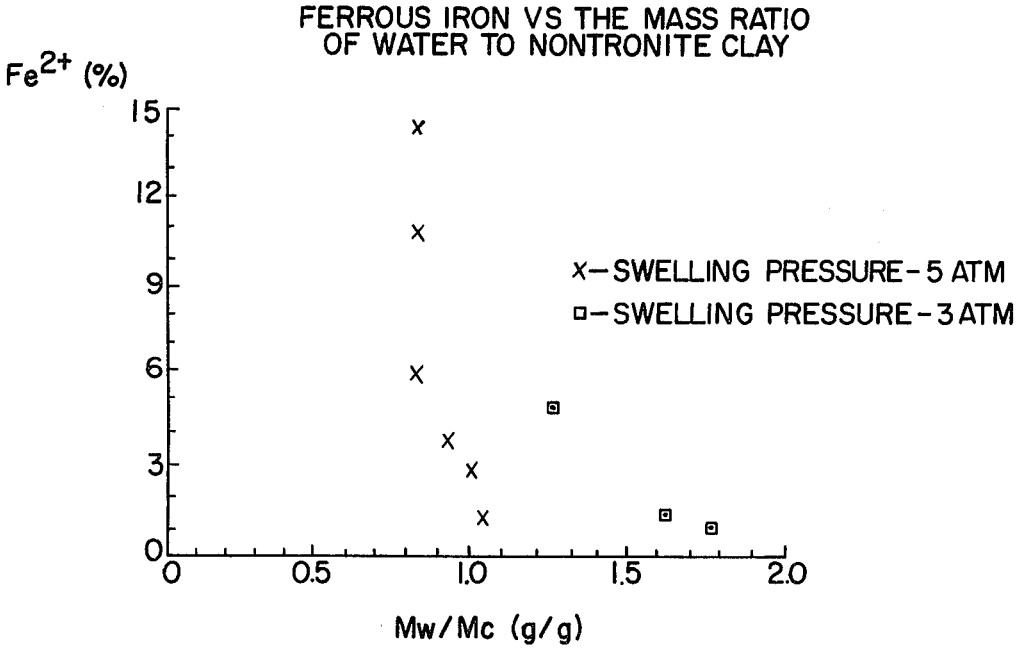
FIG. 4 is a graph illustrating the percent of reduced iron in nontronite clay versus the mass ratio of water to clay at two different swelling pressures.

Beneficiation of bentonite clay by oxidation of ferrous iron in the bentonite crystal under moist conditions is shown by the graphs of FIGS. 2 through 4.

FIG. 2 shows curves of swelling pressure $P_i$ versus the mass ratio of water to clay $M_w/M_c$ for oxidized and reduced Upton clay, which clay has a relatively low iron content. The crosses represent the unaltered (oxidized) clay and the circles represent the reduced clay. The latter was prepared by treating unaltered clay with sodium dithionite, a reducing agent, and then washing out the excess reducing agent.

FIG. 3 shows similar curves for oxidized and reduced nontronite, an iron-rich swelling clay, and FIG. 4 shows curves for the percent of reduced iron in nontronite clay versus the mass ratio of water to clay at two different swelling pressures, namely, three atmospheres and five atmospheres. It should be noted that reduced clays can be restored to their original oxidized state by exposing them to oxygen under moist conditions (Stucki, J. W. and Roth, C. B., Soil Sci. Soc. Amer. Journal 41:808–814, 1977).

As can be seen from FIGS. 2 through 4, at any $M_w/M_c$, the oxidized clays have the higher swelling pressure (i.e., the pressure exerted by a clay when it is confined between a piston and a porous plate that separates the clay from a reservoir of water). Also note that, in the nontronite clay, $M_w/M_c$ increases at a given swelling pressure as the percent of ferrous (reduced) iron decreases. In other words, swelling (i.e., the amount of water adsorbed) increases as the percent of ferrous iron decreases. Hence, it is evident that oxidized clays tend to swell more than reduced clays and that, in a given clay, the swelling at any pressure is reduced as the percent of ferrous iron increases. These results establish the fact that swelling is strongly influenced by the oxidation state of the iron in the clay crystal. Swelling is related to the plastic behavior and permeability of the clay because it is the mechanism by which the particles are dispersed. Hence, oxidation of the iron in a reduced clay under moist conditions will beneficiate it.

As can be appreciated from the foregoing, this invention provides a system and method for rapid beneficiation of bentonite clay.

What is claimed is:

1. A method for rapid beneficiation of bentonite clay, said method comprising subjecting bentonite clay to moist air while said bentonite clay is being agitated to increase the rate of oxidation of ferrous iron in sand bentonite clay.

2. The method of claim 1 wherein said bentonite clay is ground prior to subjecting said bentonite clay to moist air.

3. The method of claim 1 wherein said method includes heating said moist air prior to subjecting said bentonite clay to said air.

4. The method of claim 1 wherein said method includes agitating said bentonite clay by introducing said bentonite clay into a mixing drum where said bentonite clay is subjected to said moist air.

5. The method of claim 1 wherein said method includes drying said bentonite clay after subjecting said bentonite clay to moist air.

6. A method for rapid beneficiation of bentonite clay, said method comprising:

providing bentonite clay in a ground state;

agitating said ground bentonite clay; and subjecting said bentonite clay to moist air while said clay is being agitated to increase the rate of oxidation of ferrous iron in said bentonite clay.

7. The method of claim 6 wherein said method includes providing a rotating drum, introducing said ground bentonite clay into said drum whereby said bentonite clay is agitated by tumbling while in said drum, and introducing moist air into said rotating drum while said bentonite clay is being tumbled therein.

8. The method of claim 7 wherein sad method includes heating said moist air prior to introduction of said moist air into said rotating drum.

9. The method of claim 7 wherein said method includes providing a second rotating drum, providing a source of dry air, introducing said dry air into said rotating drum, and introducing said bentonite clay into said second drum after said bentonite clay has been subjected to said moist air.

10. A system for rapid beneficiation of bentonite clay, said system comprising:

mixing means;

means for introducing bentonite clay into said mixing means so that said bentonite clay is agitated while in said mixing means; and means for introducing moist air into said mixing means whereby said agitated bentonite clay is rapidly beneficiated while in said mixing means by increasing the rate of oxidation of ferrous iron in said bentonite clay.

11. The system of claim 10 wherein said mixing means is a rotating drum.

12. The system of claim 10 wherein said system includes heating means connected with said moist air introducing means for heating said moist air prior to introduction into said mixing means.

13. The system of claim 10 wherein said system includes drying means connected with said mixing means for receiving said bentonite clay therefrom.

14. The system of claim 13 wherein said drying means is a second rotating drum.

15. A system for rapid beneficiation of bentonite clay, said system comprising:

a first rotating drum;

a means for supplying ground bentonite clay to said first rotating drum;

means for supplying moist air to said first rotating drum to thereby increase the rate of oxidation of ferrous iron in said bentonite clay;

means for heating said moist air prior to introduction into said first rotating drum;

a second rotating drum;

means for supplying dry air to said second rotating drum; and means for transferring said bentonite clay from said first rotating drum to said second rotating drum.

* * * * *

UNITED STATES PATENT AND TRADEMARK OFFICE

CERTIFICATE OF CORRECTION

PATENT NO. : 4,411,530

DATED : October 25, 1983

INVENTOR(S) : Philip F. Low, Charles B. Roth and Joseph W. Stucki

It is certified that error appears in the above—identified patent and that said Letters Patent is hereby corrected as shown below:

Column 1, line 5, before "FIELD OF THE INVENTION" insert the following paragraph:

--Government Rights

The Government has rights in this invention pursuant to Grant Number DAAG-29-C-0004 awarded by the United States Department of the Army.--

Column 2, line 14, delete "unit" and insert --until--.

Column 5, line 38, delete "sad" and insert --said--.

Column 5, line 10, delete "sand" and insert --said--.

Signed and Sealed this

*Twenty-third* Day of *October 1984*

[SEAL]

*Attest:*

GERALD J. MOSSINGHOFF

*Attesting Officer*

*Commissioner of Patents and Trademarks*